US010435836B2

(12) United States Patent
Lundt et al.

(10) Patent No.: US 10,435,836 B2
(45) Date of Patent: Oct. 8, 2019

(54) APPARATUS FOR FEEDING AND SPREADING PIECES OF CLOTH

(71) Applicant: Jensen Denmark A/S, Ronne (DK)

(72) Inventors: Morten Lundt, Ronne (DK); Kim Cordua, Ronne (DK)

(73) Assignee: Jensen Denmark A/S, Ronne (DK)

( * ) Notice: Subject to any disclaimer, the term of this patent is extended or adjusted under 35 U.S.C. 154(b) by 3 days.

(21) Appl. No.: 15/564,156

(22) PCT Filed: Apr. 5, 2016

(86) PCT No.: PCT/EP2016/057427
§ 371 (c)(1),
(2) Date: Oct. 3, 2017

(87) PCT Pub. No.: WO2016/162334
PCT Pub. Date: Oct. 13, 2016

(65) Prior Publication Data

US 2018/0080170 A1 Mar. 22, 2018

(30) Foreign Application Priority Data

Apr. 8, 2015 (DK) ..... 2015 70201

(51) Int. Cl.
*D06F 67/04* (2006.01)

(52) U.S. Cl.
CPC ..... *D06F 67/04* (2013.01)

(58) Field of Classification Search
CPC ..... D06F 67/04; D06F 71/38
See application file for complete search history.

(56) References Cited

U.S. PATENT DOCUMENTS 3,198,315 A 8/1965 Long, Sr.
3,664,046 A 5/1972 Thompson
(Continued)

FOREIGN PATENT DOCUMENTS

CN 103998678 11/2016
EP 0523872 A1 1/1993
(Continued)

OTHER PUBLICATIONS

International Search Report issued in corresponding International Application No. PCT/EP2016/057427, dated Jul. 8, 2016.
(Continued)

*Primary Examiner* — Ismael Izaguirre
(74) *Attorney, Agent, or Firm* — McDermott Will & Emery LLP

(57) ABSTRACT

Disclosed herein is an apparatus and a method for receiving and straightening four edge pieces of cloth, the apparatus having a machine direction parallel with a delivery direction of the straightened cloth, the apparatus comprising; at least three charger stations, each for receiving a piece of cloth and locating a pair of adjacent fore edge corners of the cloth, a set of spreader clamps for releasably receiving the pair of adjacent fore edge corners, at least two grippers, each for conveying the pair of fore edge corners from the charger station to the set of spreader clamps, where the grippers are configured to move along at least a portion of a first path transversally to the machine direction, wherein at least one central charger station has a first waiting location for the cloth with the corners being located, the waiting location being retracted opposite the machine direction from the set of spreader clamps away from the first path.

17 Claims, 5 Drawing Sheets

(56) References Cited

U.S. PATENT DOCUMENTS

| | | | | |
|---|---|---|---|---|
| 5,440,810 | A | 8/1995 | Borucki et al. | |
| 5,515,627 | A * | 5/1996 | McCabe | D06F 67/04 38/143 |
| 7,380,356 | B2 * | 6/2008 | Baboz | D06F 67/04 38/143 |
| 8,028,444 | B2 | 10/2011 | Heinz et al. | |
| 8,732,995 | B2 * | 5/2014 | Herzog | D06F 67/04 38/143 |

FOREIGN PATENT DOCUMENTS

| | | | |
|---|---|---|---|
| EP | 0554204 | A1 | 8/1993 |
| EP | 0637643 | A2 | 8/1995 |
| EP | 1820894 | A1 | 8/2007 |
| EP | 2006438 | A1 | 12/2008 |
| WO | 96/03540 | A2 | 2/1996 |
| WO | 03/104542 | A1 | 12/2003 |

OTHER PUBLICATIONS

Danish Search Report issued in corresponding Danish Application No. PA 2015 70201, dated Oct. 13, 2015.
Jensen Brochure, "Jenfeed Express", High-volume feeder for optimum operator capacity. Oct. 3, 2017.
Office Action for Chinese App. No. 2016800201510, dated Jul. 3, 2019, English Translation, and Search Report, 3 pages.

* cited by examiner

APPARATUS FOR FEEDING AND SPREADING PIECES OF CLOTH

FIELD OF THE INVENTION

The invention relates to a charging and stretching apparatus comprising multiple charger stations for receiving and straightening pieces of laundry, which rapidly and accurately transfer and spread sheets of laundry and place them onto a conveyor for subsequent processing by ironing machines, folding machines or the like.

BACKGROUND OF THE INVENTION

After laundry articles such as bed sheets, table linens, blankets, or the like are washed in a laundry facility, they are typically fed into a flatwork ironer and automatic folded into a neat package for use in hotels, hospitals, or the like. In order to obtain a neatly folded, unwrinkled package, it is important that the sheet is presented to the ironer with no wrinkles or folds and with the leading edge straight.

Modern laundry facilities use an automatic spread feeder apparatus to allow more rapid and accurate feeding of the sheets into the ironer. Various spread feeder apparatus' are designed to accommodate multiple operators at different charger stations. This increases the speed at which the sheets can be fed to the spreader clamps at the spreader station and improves the overall output of the spread feeder apparatus. Such apparatus is disclosed in the U.S. Pat. No. 5,440,810.

One disadvantage of many spread feeder apparatus' are, that they do not take fully advantage of the capacity of the spreader station due to the time required for transporting the sheets of laundry from the charger stations to the spreader station.

It is therefore desirable to provide an apparatus which improve the use of the capacity of the spreader station and thereby operates even more rapidly than other spread feeder apparatus'.

SUMMARY OF THE INVENTION

Disclosed herein is an apparatus for receiving and straightening four edge pieces of cloth, the apparatus having a machine direction parallel with a delivery direction of the straightened cloth, the apparatus comprising; at least three charger stations, each for receiving a piece of cloth and locating a pair of adjacent fore edge corners of the cloth, a set of spreader clamps for releasably receiving the pair of adjacent fore edge corners, at least two grippers, each for conveying a respective piece of cloth from the charger station to the set of spreader clamps, by gripping onto the fore edge corners thereof, where the grippers are configured to move along at least a part of a first path transversally to the machine direction, wherein at least one central charger station has a first waiting location for the cloth with the corners being located, the waiting location being retracted opposite the machine direction from the set of spreader clamps away from the first path.

This arrangement allow for a more efficient use of the set of spreader clamps capacity, as the cloth can be held in the first waiting location until a gripper takes over the cloth so that another cloth can be conveyed by the gripper along the first path from an end charger station, i.e. a charger station at the end of the first path, past the awaiting cloth in the central charger station.

By an "central" charger station is meant a charger station placed in-between the two end charger stations.

Each gripper may have two clamps, wherein each clamp may grip a respective one of the two fore edge corners of the cloth.

The set of spreader clamps may be waiting in a receive position, approximately in the centre of the two end charger stations when being in its non-operating state, i.e. when it is not spreading a cloth.

The apparatus may comprise an uneven number of charger stations, such as three or five. Whereas an apparatus with three charger stations has one central charger station which may be placed in line, i.e. parallel to the machine direction, with the set of spreader clamps in their receive position. Having three charger stations and two grippers, a first gripper may collect cloths' from a left hand side end charger station and the central charger station and a second gripper may collect cloths' from a right hand side end charger station and the central charger station.

Having five charger stations and two grippers, the first gripper may collect cloths' from a left hand side end charger station and two central charger stations, i.e. a left hand side central charger stations and a mid central charger station, the second gripper may collect cloths' from a right hand side end charger station and two central charger stations, i.e. a right hand side central charger stations and the mid central charger station. Wherein the mid central charger station is placed in line, i.e. parallel to the machine direction, with the set of spreader clamps in their receive position.

The apparatus may comprise an even number of charger stations, such as four or six. Whereas an apparatus with four charger stations has two central charger stations which may be placed on each side of the set of spreader clamps in their receive position. Having four charger stations and two grippers, the first gripper may collect cloths' from a left hand side end charger station and a left hand side central charger station and the second gripper may collect cloths' from a right hand side end charger station and a right hand side central charger station.

An apparatus with six charger stations has four central charger stations wherein two central charger stations may be placed on each side of the set of spreader clamps in their receive position. Having six charger stations and two grippers, the first gripper may collect cloths' from a left hand side end charger station and two left hand side central charger stations and the second gripper may collect cloths' from a right hand side end charger station and two right hand side central charger stations.

A conveyer belt may be configured to run below the grippers along the first path, for guiding a trailing edge of the cloth. The conveyer belt may run parallel with the first path. The conveyer belt may comprise a first and a second conveyer belt.

It may be defined that the starting point for processing the cloth is to feed a fore edge of the cloth to the charger stations. The charger stations then locates a pair of trailing edge corners of the cloth which in the further processing, when spreading the cloth, becomes the pair of fore edge corners. The term "fore edge corners" is thereby used to identify the corners handled by the apparatus, i.e. when spreading a piece of cloth with the set of spreader clamps, and not necessarily the corners of the edge feed to the apparatus which may be the same or a different edge of the cloth.

In one or more embodiments the first conveyer belt and the second conveyer belt extends from the end charger station to just before a receiving position of the set of spreader clamps, so a second path of movement of the grippers towards the set of spreader clamps and parallel with the machine direction is free of the first and second conveyer belt.

The first and second conveyer belt may guide a trailing end of the cloth conveyed by the grippers from the end charger stations towards the set of spreader clamps. The first and second conveyer belt may run with the same speed as the grippers and the first and second conveyer belt may only run if guiding a trailing edge of the cloth i.e. when the grippers conveys a cloth towards the spreader clamps and is in movement. This arrangement allow for a faster delivery of the cloth along the first path.

In one or more embodiments a third conveyer belt runs between the first and second conveyer belt along the second path, the third conveyer belt optionally running in a level below the first and second conveyer belt. The width of the third conveyer belt may at least be the same as the distance between the first or second conveyer belt or wider. The first and second conveyer belt may deliver the trailing end of the cloth to the third conveyer. The trailing end of a cloth from a central charger station in line with the set of spreader clamps may be delivered to the third conveyer belt directly from the first waiting location. This arrangement allow for a faster delivery of the cloth along the second path.

In one or more embodiments the first waiting location comprises a buffer station, preferably a conveyer or a tray.

The buffer station keeps the trailing end of the cloth away from the first, second or third conveyer belt, i.e. above the first, second or third conveyer belt, until one of the grippers takes over the pair of fore edge corners from one of the charger stations. It is thereby avoided that the trailing end moves away from the respective charger station before the grippers take over the fore edge corners from one of the charger stations and starts transporting the cloth towards the spreader clamp. It is thereby further avoided that two cloths is tangled together when passing each other.

In one or more embodiments the tray is downwardly pivotable towards the first path. The buffer station may be pivoted when one of the two grippers take over the pair of fore edge corners from the charger station. The buffer station may thereby deliver the trailing end of the cloth to either the first or second conveyer belt along the first path or the third conveyer belt along the second path.

In one or more embodiments the apparatus comprises an arm configured for moving the grippers from the first path towards the charger stations and back, along a third path. The third path may be parallel with the machine direction. The arm may be a telescoping arm or a rail whereon the gripper may run. The arm may be configured for moving the grippers so that they can collect the pair of fore edge corners from charger stations placed with at least two different distances from the first path. There may be a difference in the distance of 10 to 50 cm or more preferable between 20 to 30 cm. The arms may also be configured for moving the grippers along the second path.

In one or more embodiments the grippers have a waiting position along the first path.

This arrangement allow for an even more efficient use of the set of spreader clamps capacity. This as the cloth conveyed by the first gripper may await the delivery of another cloth conveyed by the second gripper closer to the receive position of the set of spreader clamps.

In one or more embodiments the apparatus includes a central charger station and a charger station at a respective end of the first path, wherein one or both of the end charger stations have a respective one of the first waiting location being retracted opposite the machine direction from the set of spreader clamps away from the first path.

This arrangement allow for an even more efficient use of the set of spreader clamps capacity. This as both the end and central charger stations may comprise a buffer station which together with at least two waiting locations along the first path allow for at least five cloths in transit towards the set of spreader clamps at the same time, i.e. one cloth per charger station plus one cloth per gripper.

Each charger station may comprise three motors. One motor for running a feed conveyer belt an two motors for running each of two sets of locations rolls, whereas each set of location rolls locate one fore edge corner. Hereby may the feed conveyer belt be controlled separately from the two sets of location rolls, so that the cloth may be waiting close to the two sets of positioning rolls. This may allow for an even more efficient use of the set of spreader clamps capacity as the cloth may be advanced even faster towards the set of spreader clamps.

Furthermore is disclosed a method of conveying four edge pieces of cloth from at least three charger stations to a set of spreader clamps by means of at least two grippers, each for conveying a respective piece of cloth, using an apparatus for receiving and straightening the cloth having a machine direction parallel with a delivery direction of the straightened cloth, the method comprising: locating a pair of fore edge corners of a first piece of cloth by means of one of the charger stations, collecting the located pair of fore edge corners of the first piece of cloth from the one charger station by one of the grippers, and conveying the first piece of cloth from the charger station to the set of spreader clamps by the one gripper along at least a part of a first path transversally to the machine direction, wherein at least one central charger station is configured to define a cloth waiting position which is retracted from the first path in a direction opposite the machine direction, and the method further comprises the step of holding a second piece of cloth, with the pair of fore edge corners thereof being located, in the first waiting location of the central charger station before the second piece of cloth is collected by the grippers and while the first piece of cloth is conveyed to the set of spreader clamps.

The charger station for locating a pair of fore edge corners of the first piece of cloth may be one of the end charger stations. If the apparatus comprises five charger stations or more the charger station for locating a pair of fore edge corners of the first piece of cloth may be one of the end charger stations or one of the central charger stations.

In one or more embodiments the aforementioned method is performed with the apparatus described above.

BRIEF DESCRIPTION OF THE DRAWINGS

An embodiment of the invention will now be described, by way of example only, with reference to the accompanying drawings, as follows.

DESCRIPTION OF PREFERRED EMBODIMENTS

Figure 1:
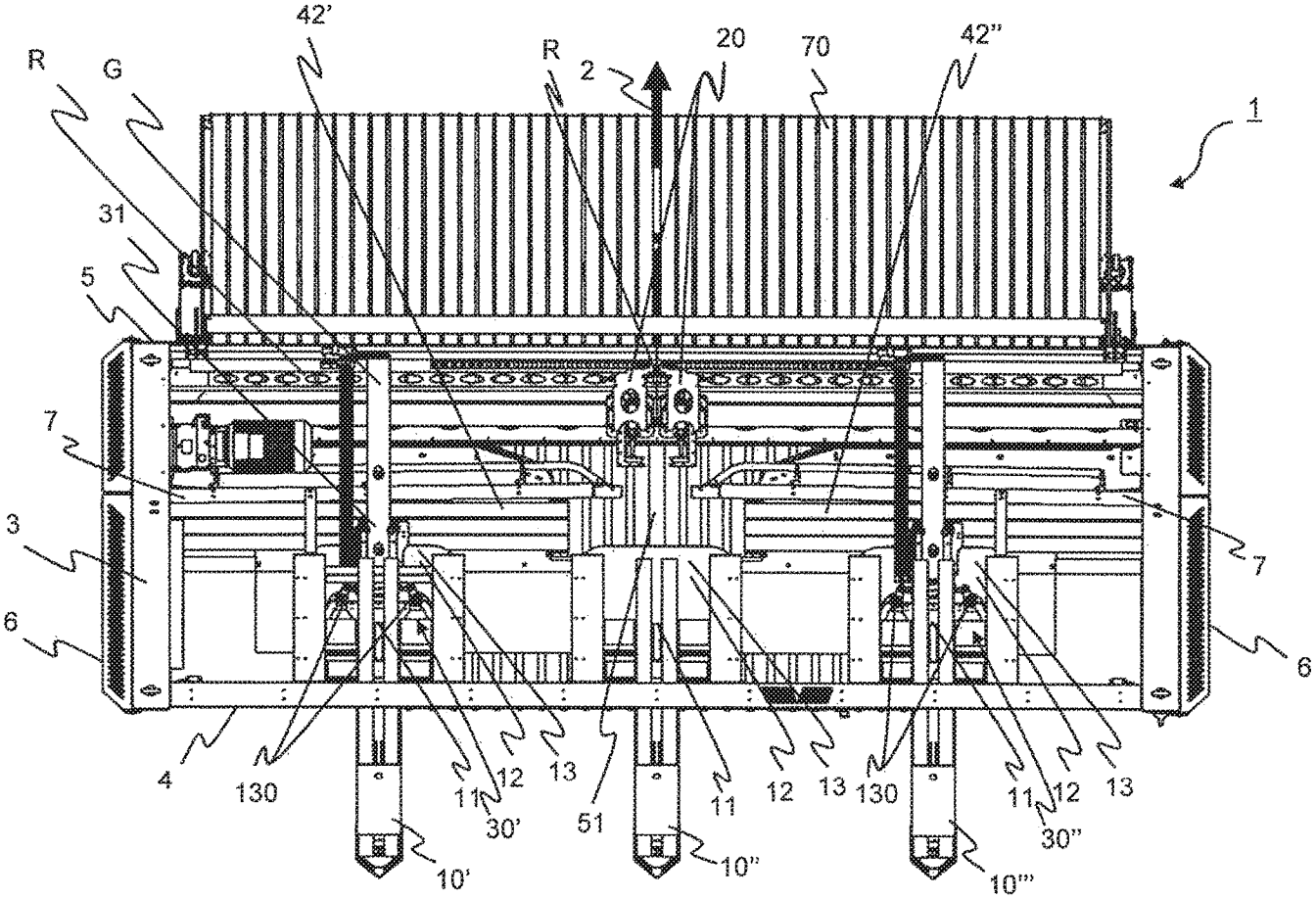
FIG. 1 schematically shows a top view of an apparatus for receiving and straightening a four edge piece of cloth, where each gripper is in a collect position.
Figure 2:
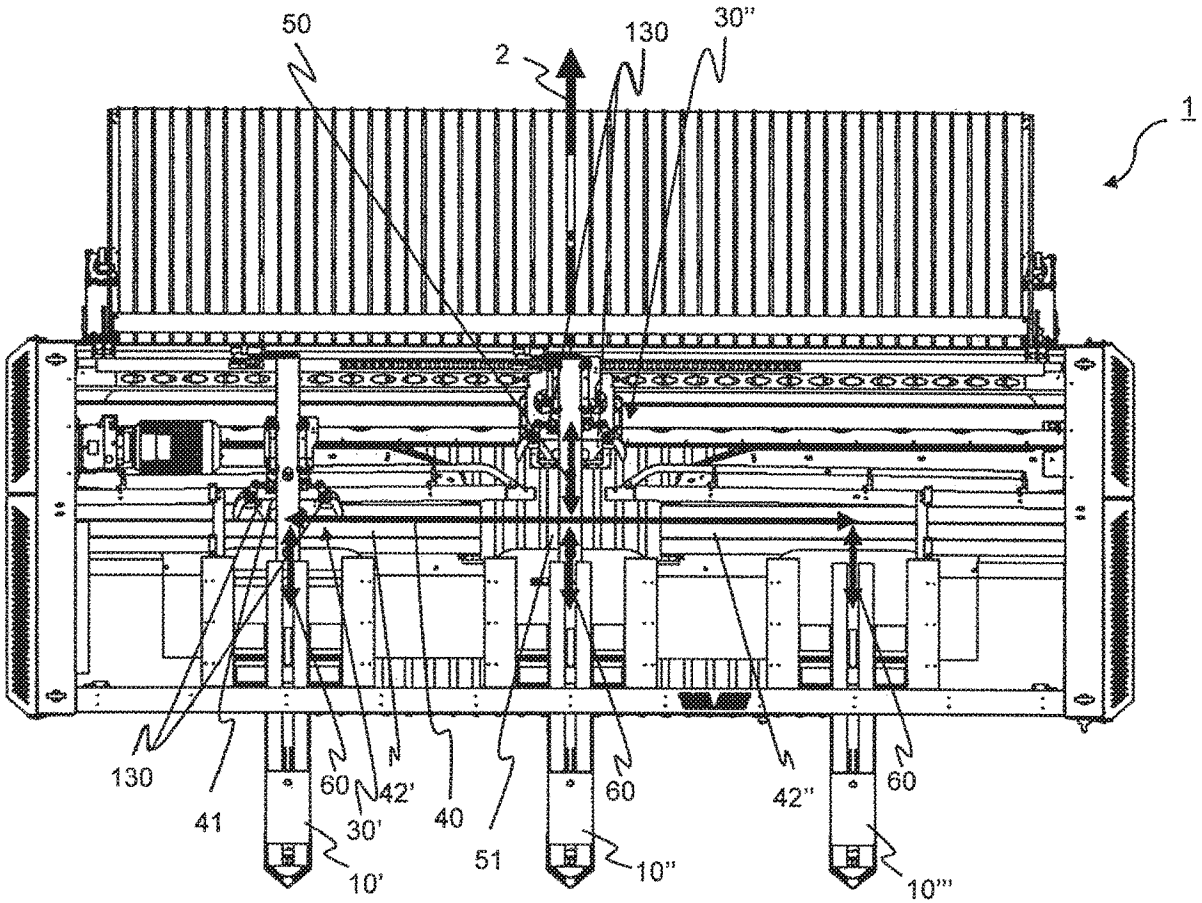
FIG. 2 schematically shows a top view of an apparatus for receiving and straightening a four edge piece of cloth, where the first gripper is in a waiting position and the second gripper is in a transfer position.

FIGS. 1 and 2 schematically show a top view of an apparatus 1 according to the invention for receiving and straightening a four edge piece of cloth (not shown) having a machine direction 2 parallel with a delivery direction of the straightened cloth. The apparatus 1 includes a housing 3 (see also FIG. 3) having a front wall 4, an end wall 5, as well as two opposite longitudinal sides 6 extending parallel with the machine direction 2. The housing is partially divided into two sections by two partition walls 7 each extending from one of the end walls 6 towards the center of the apparatus 1 and perpendicular to the machine direction 2, whereas the two partition walls 7 define an opening between the two sections approximately in the center of the apparatus 1.

The apparatus 1 comprises three charger stations 10', 10", 10'", each for receiving a mid-section of a piece of cloth, if the cloth is rectangular preferably a mid section of one of the longer edges, and for locating a pair of adjacent trailing edge corners of the cloth which from then becomes the fore edge corners. All three charger stations 10', 10", 10'" are in the presently illustrated embodiment retracted parallel with the machine direction 2 from a set of spreader clamps 20, i.e. retracted from the first path 40 in the direction opposite the machine direction 2, and defining a first waiting location 11 comprising a buffer station 12 in shape of a tray 13.

The apparatus further comprises a first and a second gripper 30', 30" for conveying the pair of fore edge corners from the charger stations 10', 10", 10'" to the set of spreader clamps 20.

The first and second gripper 30', 30" is configured to move along a respective portion of a first path 40 (see FIG. 2) transversally to the machine direction 2, between the centre of the apparatus 1 and one of the end charger stations 10', 10'". This may be by means of a rail R running parallel with the first path 40 and carrying a gripper support G. A first conveyer belt 42' and a second conveyer belt 42" extends from each end/outermost charger stations 10', 10'" towards the center of the apparatus 1 to just before the set of spreader clamps 20 in their receive position R, so a second path 50 of movement of the grippers 30', 30" (see FIG. 2) from the first path 40 towards the set of spreader clamps 20 and parallel with the machine direction 2 is free of the first and second conveyer belt. The second path 50 goes through the before mentioned opening defined by the partition walls 7. A third conveyer belt 51 runs between and in a level below the first and second conveyer belt 42', 42" along the second path 50. The first path 40 preferably extends symmetrically away from the second path 50.

An arm 31 which is a part of the gripper support G, is configured for moving the grippers from the first path 40 towards the charger stations 10', 10", 10'" and back, i.e. along a respective third path 60, preferably parallel with the second path 50, as well as along the second path 50.

Each gripper has in the presently illustrated embodiment two clamps 130, each clamp 130 having opposite closeable arms defining a gap between which a respective one of the fore edge corners is gripped.

The set of spreader clamps 20 is configured for releasably receiving the pair of adjacent fore edge corners from the two grippers 30', 30" in turn and then moving in opposite directions from each other away from the centre of the apparatus and transversally to the machine direction 2. Hereby is the cloth straightened and delivered to a fourth conveyer belt 70 for conveying the straightened cloth to a flatwork ironer, an automatic folder or the like (not shown).

Turning now to FIGS. 3-7 the conveying operation performed by the grippers 30', 30" from the charger stations 10', 10", 10'" to the set of spreader clamps 20 will be described by discussing the progressive figures from FIG. 3 to FIG. 7 together with the FIGS. 1 and 2.

Figure 3:
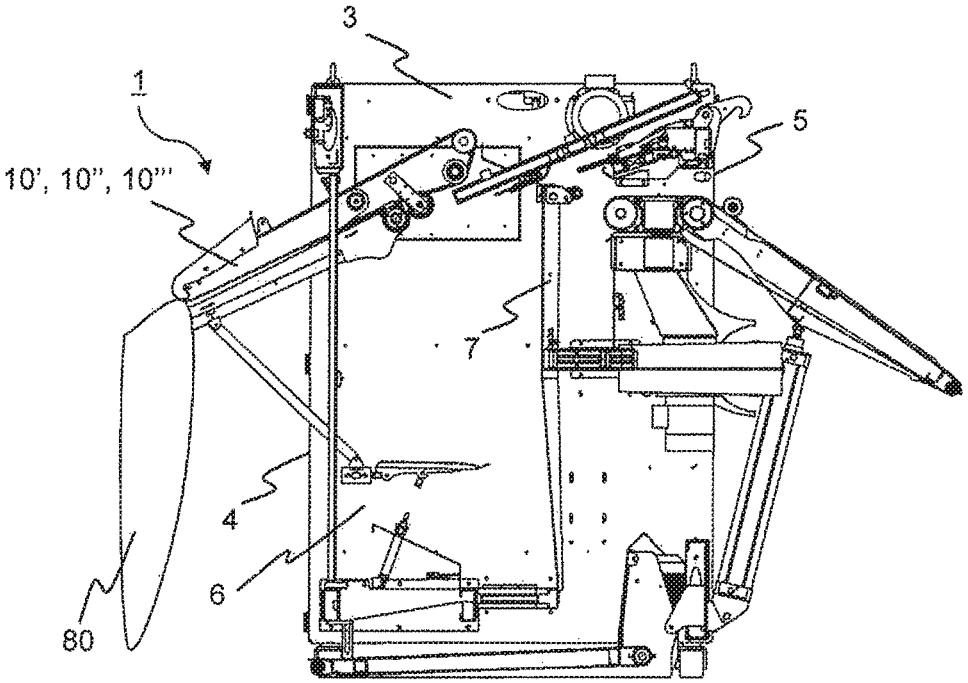
FIGS. 3-7 schematically show a process of conveying a cloth from a charger station to a set of spreader clamps in a cross-sectional view of the apparatus.
Figure 4:
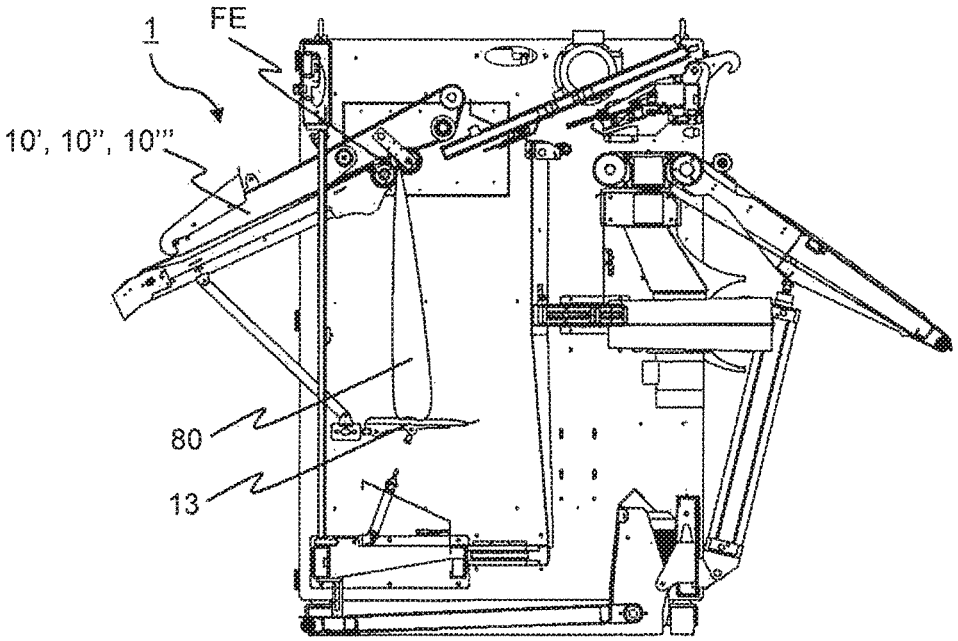

As can be seen in FIG. 3 a cloth 80 is feed to one of the charger stations 10', 10", 10'". The charger station 10', 10", 10'" then locates the fore edge corners FE of the cloth 80 and holds the cloth in the corners FE in a first waiting location above a tray 13 as shown on FIG. 4. Providing such a waiting location off-set from the first path 40 (see FIG. 1) allows for the grippers 30', 30" to move the cloth from the end charger stations 10', 10'" to a transfer position T (see FIG. 7) while the cloth is ready to be picked up from the central station(s) by a gripper 30', 30" in a subsequent step.

Figure 5:
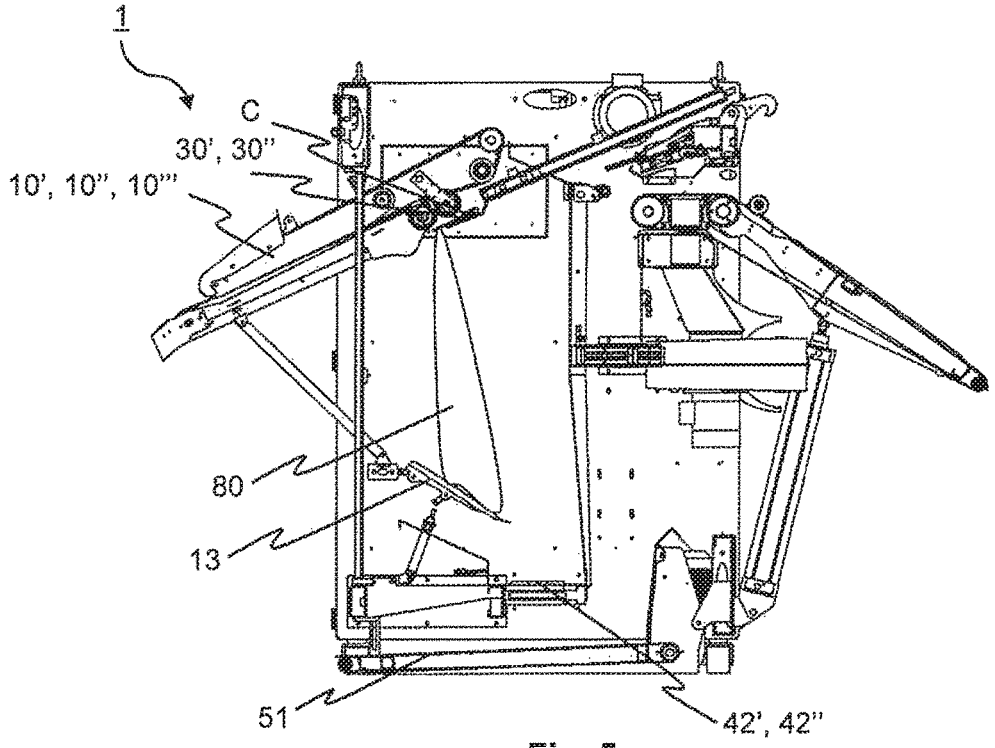

As shown in FIG. 5 one of the two grippers 30', 30" moves towards one of the three charger stations 10', 10", 10'" along one of the third paths 60 (see FIG. 2) into its collect position C and the tray 13 is downwardly pivoted. Hereby is the trailing edge of the cloth 80 delivered to the first or second conveyer belt 42', 42" if taken from one of the end charger stations 10', 10'" (see FIG. 1) or to the third conveyer belt 51 if taken from the central charger station 10" (see FIG. 1).

Figure 6:
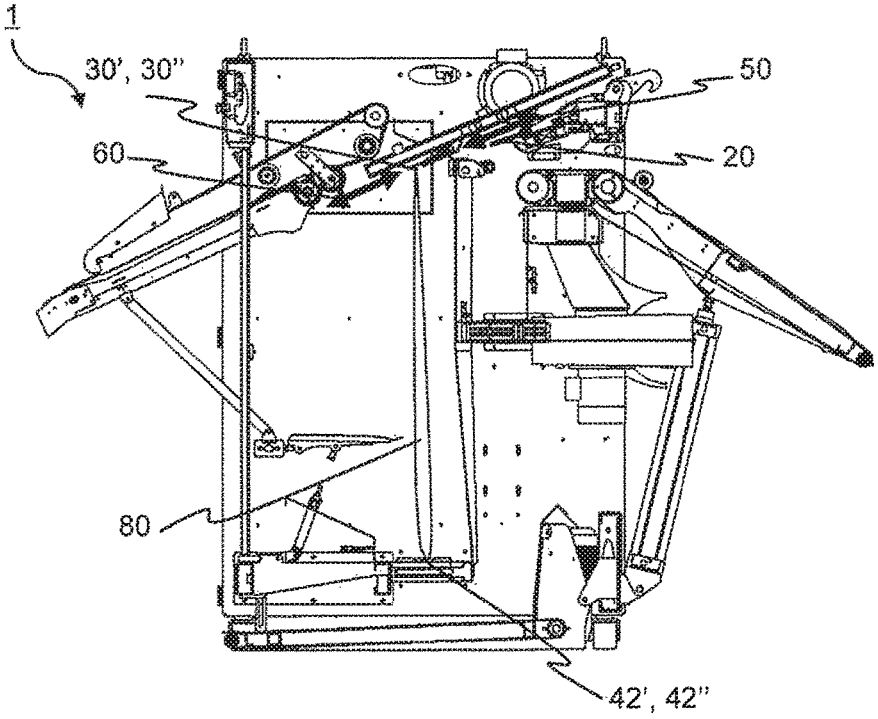

The gripper 30', 30" is then moved back along the third path 60 (see also FIG. 2) to the first path 40 as shown in FIG. 6. If the cloth 80 is taken from the central charger station 10" (see FIG. 1) the gripper 30', 30" may preferably continue along the second path 50 (see also FIG. 2) towards the set of spreader clamps 20 to the transfer position T. If the cloth is taken from one of the end charger stations 10', 10'" (see FIG. 1) the gripper 30', 30" may either move along the first path 40 and continue directly along the second path 50 to the transfer position T, or the gripper 30', 30" may stop at a waiting position 41 along the first path 40 (see FIG. 2) and wait for its turn to approach the set of spreader clamps 20, i.e. until the other gripper has moved away from the second path 50 and towards the opposite outermost/end charger station 10', 10'" along the first path 40 or towards the central charger station 10" along the third path 60.

The first conveyer belt 42' runs in the direction towards the center of the apparatus when the first gripper 30' approaches the set of spreader clamps 20 with a cloth 80 from the end charger station 10' along the first path 40 (see FIG. 2).

The second conveyer belt 42" runs in the direction towards the center of the apparatus when the second gripper 30" approach the set of spreader clamps 20 with a cloth 80 from the end charger station 10'" along the first path 40 (see FIG. 2).

The third conveyer belt 51 runs in the machine direction 2 when the first or second gripper 30', 30" has collected a cloth 80 from the central charger station 10" and when one of the two grippers 30', 30" approach the set of spreader clamps 20 with a cloth 80 from one of the end charger stations 10', 10'" along the second path 50 (see also FIG. 2).

Figure 7:
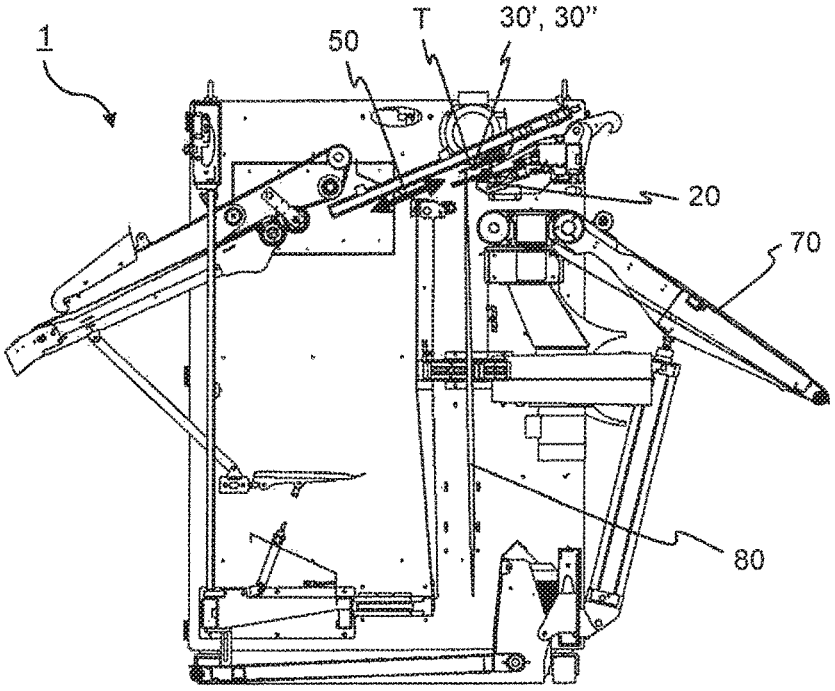

Finally as shown in FIG. 7 the gripper 30', 30" moves toward the set of spreader clamps 20 along the second path 50 into the transfer position T and the cloth 80 is transferred from the gripper 30', 30" to the set of spreader clamps 20 so that the set of spreader clamps 20 can spread out the cloth and deliver it to the fourth conveyer belt 70. The movement of the spreader clamps and the delivery of the cloth to the fourth conveyer belt are discussed in WO 2012/163356.

Figure 8:
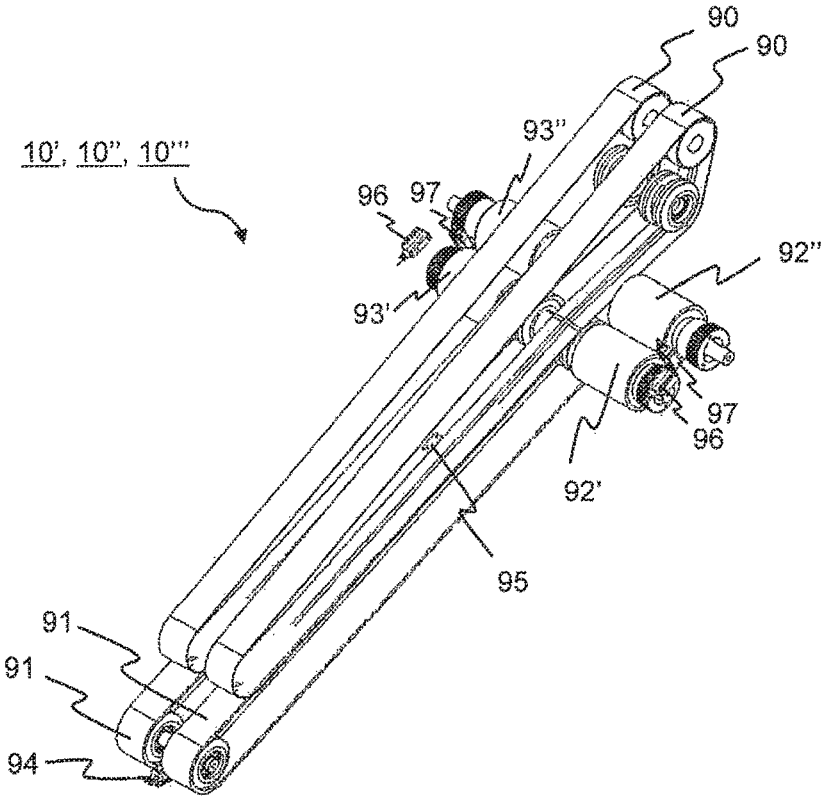
FIG. 8 schematically shows a perspective view of a construction of a charger station.

As shown on FIG. 8 each charger station 10', 10", 10'" may in one embodiment comprise an upper and lower feed conveyer belt 90 and 91, two set of location rolls 92', 92" and 93', 93" and three motors (not shown), whereas the upper and lower feed conveyer belt is controlled by one motor and each set of location rolls are controlled by their own motor, i.e. each set of location rolls are controlled by a separate motor.

The rolls of each set of locations rolls e.g. 92' and 92" are spaced apart, creating a gap (not shown) between the rolls 92' and 92", when they are not in engagement with a cloth.

When feeding a cloth (not shown) to the charger station 10', 10", 10'" a first sensor 94 is affected and the upper and lower feed conveyer belt 90 and 91 start running. The cloth is advanced in-between the upper and lower feed conveyer belt until the cloth affects a second sensor 95.

If the set of locations rolls 92', 92" and 93', 93" already is in engagement with the fore edge corners of a previously loaded cloth which is at the aforementioned first waiting location 11 (see FIG. 1), the upper and lower feed conveyer belt 90 and 91 stops and holds the cloth waiting until one of the grippers 30', 30" (see FIG. 1) have taken the previously loaded cloth from the two sets of location rolls.

If the set of locations rolls 92', 92" and 93', 93" are free, i.e. the two rolls in each set of location rolls is spaced apart, the cloth continues past the second sensor 95 and the two sets of location rolls 92', 92" and 93', 93" starts rotating at a high speed. When a third and or fourth sensor 96 and 97 is affected by the cloth the two rolls in each set of location rolls 92', 92" and 93', 93" are urged towards each other independently and the cloth is advanced by the rolls of the two sets of location rolls.

When the entire cloth has passed the second sensor 95, the two sets of location rolls 92', 92" and 93', 93" slows down to a medium speed, and when the trailing edge corners of the cloth which from then becomes the fore edge corners have passed the third sensor 96, the two sets of location rolls 92', 92" and 93', 93" slow down to a slow speed.

Finally when the fore edge corners have passed the fourth sensor 97, the two sets of location rolls 92', 92" and 93', 93" slow down and stop, holding the fore edge corners of the cloth ready for the gripper 30', 30" (see FIG. 1) to take over the corners.

The first, second, third and/or fourth sensor 94, 95, 96, 97 may be photocells which are affected by the cloth as the sensors are darkened or covered by the cloth.

The principles discussed with reference to FIG. 8 may find use independently of the apparatus specifically claimed in the claims.

The invention claimed is:

1. An apparatus for receiving and straightening four edge pieces of cloth, said apparatus having a machine direction parallel with a delivery direction of said straightened cloth, said apparatus comprising:

at least three charger stations, each having a charger station apparatus for receiving a piece of cloth and locating a pair of adjacent fore edge corners of said cloth, a set of spreader clamps for releasably receiving said pair of adjacent fore edge corners, at least two grippers, each for conveying a respective piece of cloth from a charger station apparatus to said set of spreader clamps, by gripping onto said located fore edge corners thereof, where said grippers are configured to move along at least a part of a first path transversally to said machine direction, wherein at least one central charger station has a first waiting location for said cloth with said fore edge corners being located, said waiting location being retracted opposite said machine direction from said set of spreader clamps away from said first path.

2. The apparatus according to claim 1, wherein a first conveyer belt and second conveyer belt extends from an end charger station to just before a receiving position of said set of spreader clamps, a second path of movement of said grippers towards said set of spreader clamps and parallel with said machine direction between said first and second conveyer belt.

3. The apparatus according to claim 2, wherein a third conveyer belt runs between said first and second conveyer belt along said second path.

4. The apparatus according to claim 1, wherein said first waiting location comprises a conveyer or a tray.

5. The apparatus according to claim 4 wherein said tray is downwardly pivotable towards said first path.

6. The apparatus according to claim 1, wherein said apparatus comprises an arm configured for moving said grippers from said first path towards said charger stations and back, along a third path.

7. The apparatus according to claim 1, wherein said grippers has a waiting position along said first path.

8. The apparatus according to claim 1, including a central charger station and a charger station at a respective end of said first path wherein one or both of said end charger stations has a respective one of said first waiting location being retracted opposite said machine direction from said set of spreader clamps away from said first path.

9. A method of conveying four edge pieces of cloth from at least three charger stations, each charger station having a charger station apparatus for receiving a piece of cloth and locating a pair of adjacent fore edge corners of said cloth, to a set of spreader clamps by means of at least two grippers, each for gripping a respective piece of cloth, using an apparatus for receiving and straightening said cloth having a machine direction parallel with a delivery direction of said straightened cloth, the method comprising:

locating a pair of fore edge corners of a first piece of cloth by means of one of said charger station apparatuses, collecting said located pair of fore edge corners of said first piece of cloth from said one charger station apparatus by one of said grippers, and conveying said first piece of cloth from said charger station apparatus to said set of spreader clamps by said one gripper moving along at least a part of a first path transversally to said machine direction, wherein at least one central charger station is configured to define a cloth waiting position which is retracted from said first path in a direction opposite said machine direction, characterized in holding a second piece of cloth, with said pair of fore edge corners thereof being located, in said first waiting location of said central charger station before said second piece of cloth is collected by said grippers and while said first piece of cloth is conveyed to said set of spreader clamps.

10. The method according to claim 9 performed with an apparatus for receiving and straightening four edge pieces of cloth, said apparatus having a machine direction parallel with a delivery direction of said straightened cloth, said apparatus comprising;

at least three charger stations, each charger station having a charger station apparatus for receiving a piece of cloth and locating a pair of adjacent fore edge corners of said cloth, a set of spreader clamps for releasably receiving said pair of adjacent fore edge corners, at least two grippers, each for conveying a respective piece of cloth from said charger station apparatus to said set of spreader clamps, by gripping onto said fore edge corners thereof, where said grippers are configured to move along at least a part of a first path transversally to said machine direction, wherein at least one central charger station has a first waiting location for said cloth with said corners being located, said waiting location being retracted opposite said machine direction from said set of spreader clamps away from said first path.

11. An apparatus for receiving and straightening four edge pieces of cloth, said apparatus having a machine direction parallel with a delivery direction of said straightened cloth, said apparatus comprising;

at least three charger stations, each having a charger station apparatus for receiving a piece of cloth and locating a pair of adjacent fore edge corners of said cloth, a set of spreader clamps for releasably receiving said pair of adjacent fore edge corners, at least two grippers, each for conveying a respective piece of cloth from a charger station apparatus to said set of spreader clamps, by gripping onto said located fore edge corners thereof, where said grippers are configured to move along at least a part of a first path transversally to said machine direction, wherein at least one central charger station has a first waiting location for said cloth with said fore edge corners being located, said waiting location being retracted opposite said machine direction from said set of spreader clamps away from said first path, said charger station apparatus receiving said piece of cloth between an upper and lower feed conveyor belt, a first conveyer belt and second conveyer belt extends from an end charger station to just before a receiving position of said set of spreader clamps, a second path of movement of said grippers towards said set of spreader clamps and parallel with said machine direction between said first and second conveyer belt.

12. The apparatus according to claim 11, wherein a third conveyer belt runs between said first and second conveyer belt along said second path.

13. The apparatus according to claim 11, wherein said first waiting location comprises a conveyer or a tray.

14. The apparatus according to claim 13 wherein said tray is downwardly pivotable towards said first path.

15. The apparatus according to claim 11, wherein said apparatus comprises an arm configured for moving said grippers from said first path towards said charger stations and back, along a third path.

16. The apparatus according to claim 11, wherein said grippers has a waiting position along said first path.

17. The apparatus according to claim 11, including a central charger station and a charger station at a respective end of said first path wherein one or both of said end charger stations has a respective one of said first waiting location being retracted opposite said machine direction from said set of spreader clamps away from said first path.

* * * * *